United States Patent [19]

Takahashi et al.

[11] Patent Number: 4,899,673

[45] Date of Patent: Feb. 13, 1990

[54] CONTROL DEVICE FOR CYCLIC SEWING MACHINE

[75] Inventors: Akio Takahashi, Hashima; Mamoru Yasuda, Kasugai, both of Japan

[73] Assignee: Brother Kogyo Kabushiki Kaisha, Japan

[21] Appl. No.: 317,524

[22] Filed: Mar. 1, 1989

[30] Foreign Application Priority Data

Mar. 3, 1988 [JP] Japan ..... 63-50488

[51] Int. Cl.[4] ..... D05B 3/00; D05B 69/26

[52] U.S. Cl. ..... 112/67; 112/274; 112/284

[58] Field of Search ..... 112/67, 65, 87, 271, 112/274, 284

[56] References Cited

U.S. PATENT DOCUMENTS

| | | | |
|---|---|---|---|
| 3,482,535 | 12/1969 | Hayashi et al. | 112/67 |
| 3,693,564 | 9/1972 | Hsiao | 112/67 X |
| 3,705,561 | 12/1972 | Sakawa et al. | 112/67 |
| 3,832,961 | 9/1974 | Nakamura et al. . | |
| 3,859,940 | 1/1975 | Nakamura | 112/67 X |
| 3,894,500 | 7/1975 | Hsiao | 112/274 |
| 3,908,568 | 9/1975 | Fujii | 112/274 X |
| 4,730,565 | 3/1988 | Iizuka | 112/67 |

FOREIGN PATENT DOCUMENTS

| | | |
|---|---|---|
| 4522697 | 7/1970 | Japan . |
| 5613480 | 3/1981 | Japan . |
| 5923835 | 6/1984 | Japan . |

*Primary Examiner*—H. Hampton Hunter
*Attorney, Agent, or Firm*—Oliff & Berridge

[57] ABSTRACT

A control device for a cyclic sewing machine for controlling driving condition of a main shaft of a cyclically operated sewing machine. The control device includes a clutch mechanism provided between a driving source and a main shaft, a switching member for switching the clutch mechanism between a power cutoff condition, a low-speed drive condition and a high-speed drive condition, a control cam rotatable at a reduced speed in interlinked relation to the main shaft, and a lost-motion connecting means. When switch the sewing machine from the power cutoff condition to the low-speed condition, a lost-motion is produced between the operating member and the switching member. The control cam is rotated in response to rotation of the main shaft, the operating member and the switching member are moved in accordance with cam profile. The clutch mechanism and hence the main shaft are switched between the drive conditions based on the movement of the switching member.

5 Claims, 15 Drawing Sheets

CONTROL DEVICE FOR CYCLIC SEWING MACHINE

BACKGROUND OF THE INVENTION

The present invention relates to a control device for cyclic sewing machine, and more particularly to an improvement of a control device for controlling driving condition of a cyclically operated sewing machine.

There is known a cyclic sewing machine which initiates its cyclic sewing operation by a start control manipulation and stops in a predetermined position after a predetermined sewing operation has been performed.

One conventional control device for a cyclic sewing machine is disclosed in Japanese Patent Publication No. 45-22697 (published July 31, 1970). In such Conventional control device, a clutch mechanism for controlling the driving condition of a main shaft comprises a plurality of pulleys, two driving belts each having circular cross-section mounted on the pulleys and a lever for moving the driving belts.

However, in the conventional device, since switching of the main shaft between the high-speed drive condition and the low-speed drive condition are effected by forcibly moving the driving belts with the lever, thus the switching cannot be effected stably and reliably. Further, if the belt having circular cross-section is used, the belts cannot transmit large amounts of power to the main shaft due to shortage of friction between the belt and the pulleys.

The control device for a cyclic sewing machine employing another type of a clutch mechanism has heretofore been proposed to overcome the above-described drawbacks in Japanese Patent Publication No. 56-13480 (published Mar. 28, 1981) corresponding to U.S. Pat. No. 3,908,568. In this conventional control device, the clutch mechanism comprises a pulley, disk-like clutch plates disposed coaxially with the pulley, a flat belt mounted on the pulley and a switching lever for switching engagement condition between the pulley and the clutch plates.

In this device, since the pulley engages the clutch plates stably, the switching can be effected stably and reliably.

On the other hand, a cam for controlling the switching lever which is rotatable at a reduced speed in interlinked relation to the main shaft has a stop control recess defined in an outer periphery thereof, a low-speed control cam surfaces disposed on each side of the stop control recess and positioned radially outwardly of the stop control recess, and a high-speed control cam surface positioned radially outwardly of the low-speed control cam surfaces. The cam and the switching lever are interlinked through a link member of which a roller is urged to always contact the cam surfaces by a spring. In response to operation of a treadle, an operating lever is turned against the biasing force of the spring to displace the roller on a link member out of the stop control recess, and at the same time the switching lever is turned into a low-speed control position against the biasing force of the spring. The turning movement of the switching lever operates a clutch mechanism to connect the main shaft to a low-speed drive source, thus starting to rotate the main shaft at low speed. When the cam is rotated upon the rotation of the main shaft, the roller on the link member is successively brought into engagement with the high-speed control cam surface and the low-speed control cam surfaces according to the cam profile. Upon the engagement of the roller with these cam surfaces, the switching lever is moved into a high-speed control position in which the main shaft is coupled to a high-speed drive source, after which the switching lever is returned to stop control position via the low-speed control position.

It has found that the conventional control device for sewing machine of the above structure suffers from the following problems.

The operating lever is directly subjected to the biasing force of the spring. When an operator steps down the treadle, the operating lever is turned against the biasing force of the spring. Therefore, the spring having the powerful biasing force cannot be used because of necessity of lightening the operator's burden. This causes the roller on the link member to disengage from the cam surfaces temporarily. As a result, when the main shaft of the sewing machine is stopped, there is developed resistance to the return of the roller on the link member from the high-speed control position to the stop control position under the resiliency of the spring, so that the roller moves with a delay in following up the different cam surfaces. Therefore, the timing of switching the main shaft from the high-speed drive source to the low-speed drive source is delayed, and the transmission of power to the main shaft is cut off before the rotational speed of the main shaft is sufficiently reduced. A stopper then violently hits a stop groove defined in a stop member fixedly mounted on the main shaft, components of the sewing maching tend to be damaged. Further, a stopper tends to bounce out of the stop groove whereupon the main shaft is stopped, the sewing needle of the sewing machine is liable to stop in different positions.

To avoid the above drawbacks, the cam profile may be changed so as to prolong the low-speed period, to thereby advance the timing of switching the main shaft from the high-speed drive source to the low-speed drive source. This solution however causes another problem that the cyclic period of time of the sewing machine is longer, since the time of the low-speed condition is longer.

Still another conventional control device for a sewing machine is described in U.S. Pat. No. 3,894,500.

SUMMARY OF THE INVENTION

In view of the aforesaid shortcomings of the conventional cyclic sewing machines, it is an object of the present invention to provide a sewing machine control device for stably stopping operation of a sewing machine and preventing various components of the sewing machine from being damaged.

In order to achieve the above object according to the present invention, there is provided a control device for cyclic sewing machine for controlling the driving condition of a sewing machine main shaft (2) rotatably supported on a sewing machine frame (1) end connected to a driving source (70); the control device comprising: a clutch mechanism (3) provided between the driving source (70) and the main shaft (2), the clutch mechanism (3) including at least one pulley (7,8) rotatably provided on the main shaft (2) and rotated by the driving source (70) and at least one clutch member (4,5) rotatable together with the main shaft (2); a switching member (11L) movable selectively into three different positions for switching a clutch mechanism (3) between a power cutoff condition, a low-speed drive condition, and a high-speed drive condition with relative movement of the pulley (7,8) and the clutch member (4,5) in an axial direction of the main shaft (2); an engaging member (14) connected to the switching member (11L) for engaging with the main shaft (2) and stopping the rotation thereof when the switching member (11L) is moved into the position corresponding to the power cutoff condition; a control cam (31) rotatable at a reduced speed in interlinked relation to the main shaft (2), the control cam including a first control portion (32) corresponding to the power cutoff condition for the main shaft (2), second control portions (33*a*, 33*b*) disposed on each side of the first control portion (32) radially inwardly of the first control portion (32) toward the center of rotation of the control cam (31) and corresponding to the low-speed drive condition. and a transition portion (34) extending radially inwardly of the second control portions (33*a*, 33*b*) toward the center of rotation of the control cam (31); an operating member (36) movably mounted on the frame (1) and operatively coupled to the switching member (11L), the operating member (36) being engageable with the control cam (31); a third control portion (46) integral with or separate from the control cam (31) for limiting further movement of the operating member (36) which has moved from the second control portions (33*a*, 33*b*) past the transition portion (34), the third control portion (46) corresponding to the high-speed drive condition for the main shaft (2); an urging means (37) for normally urging the operating member (36) in a direction to engage the control cam (31); a lost-motion connecting means (40,42;21,57) disposed between the operating member (36) and the switching member (11L) to produce a lost-motion; and, a control member (15) operatively coupled to the switching member (11L) and operable under an applied external force for moving the switching member (11L) from the power cutoff condition to the low-speed drive condition to rotate the main shaft (2) at a low speed.

When the switching member is moved by the control member to switch the clutch mechanism from the power cutoff condition to the low-speed drive condition, the main shaft of the sewing machine is driven at a low-speed. The lost-motion connecting means produce a lost-motion only at this time, thus preventing the movement of the switching member from being transmitted to the operating member. As the control cam is rotated in response to rotation of the main shaft, the operating member moves out of engagement with the first control portion into engagement with the second control portion, and thereafter moves past the transition portion, after which the movement of the operating member is limited by the third control portion. Based on continued rotation of the control cam, the operating member is moved toward the second control portion, and then successively engages the second control portion and the first control portion. When the operating member engages the different control portions successively, the switching member is shifted in position by the lost-motion connecting means which is being prevented from producing any lost-motion. The clutch mechanism and hence the main shaft are switched between the drive conditions based on the movement of the switching member.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

A first embodiment of the present invention will hereinafter be described in detail with reference to FIGS. 1 through 11.

Figure 1:
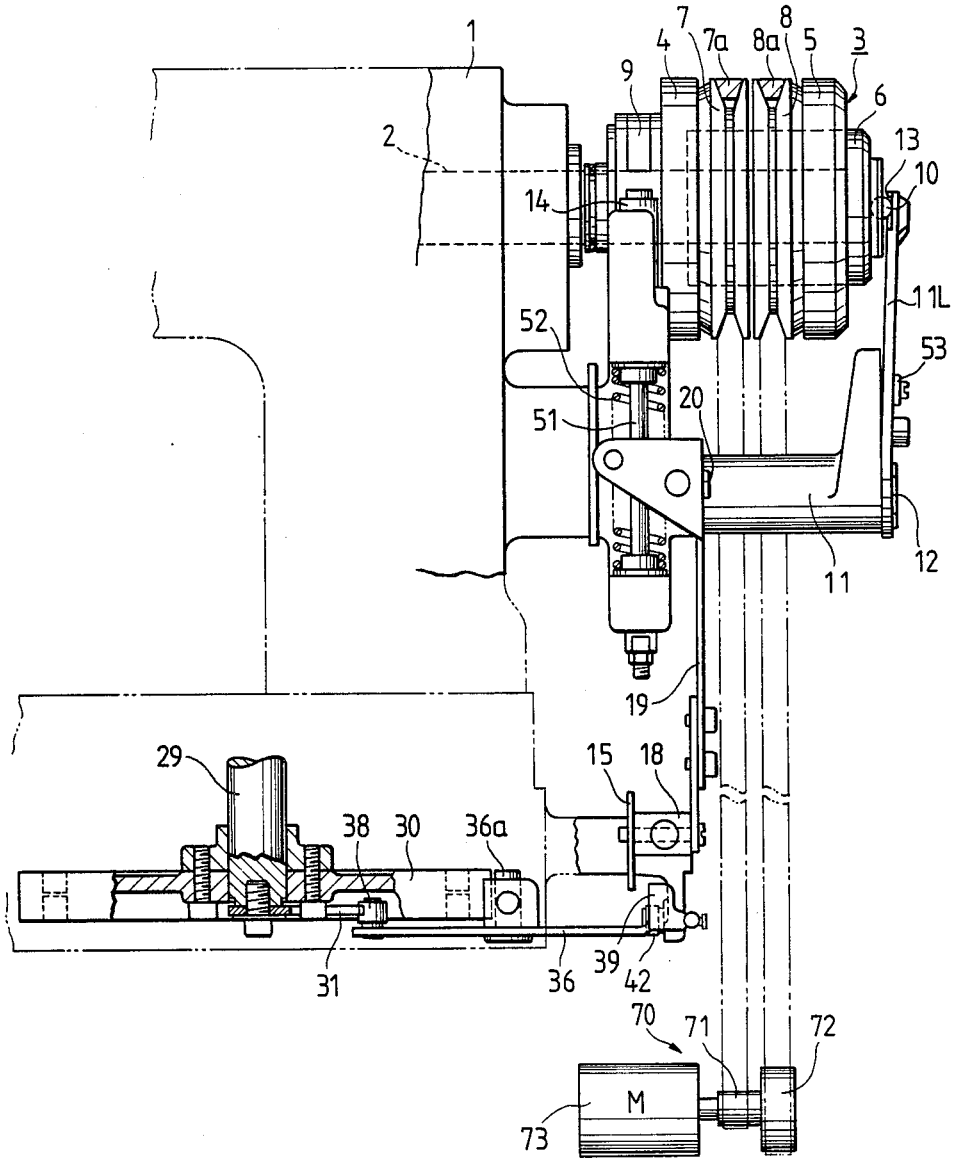
FIG. 1 is a fragmentary side elevational view of a cyclic sewing machine of a first embodiment of the present invention.
Figure 2:
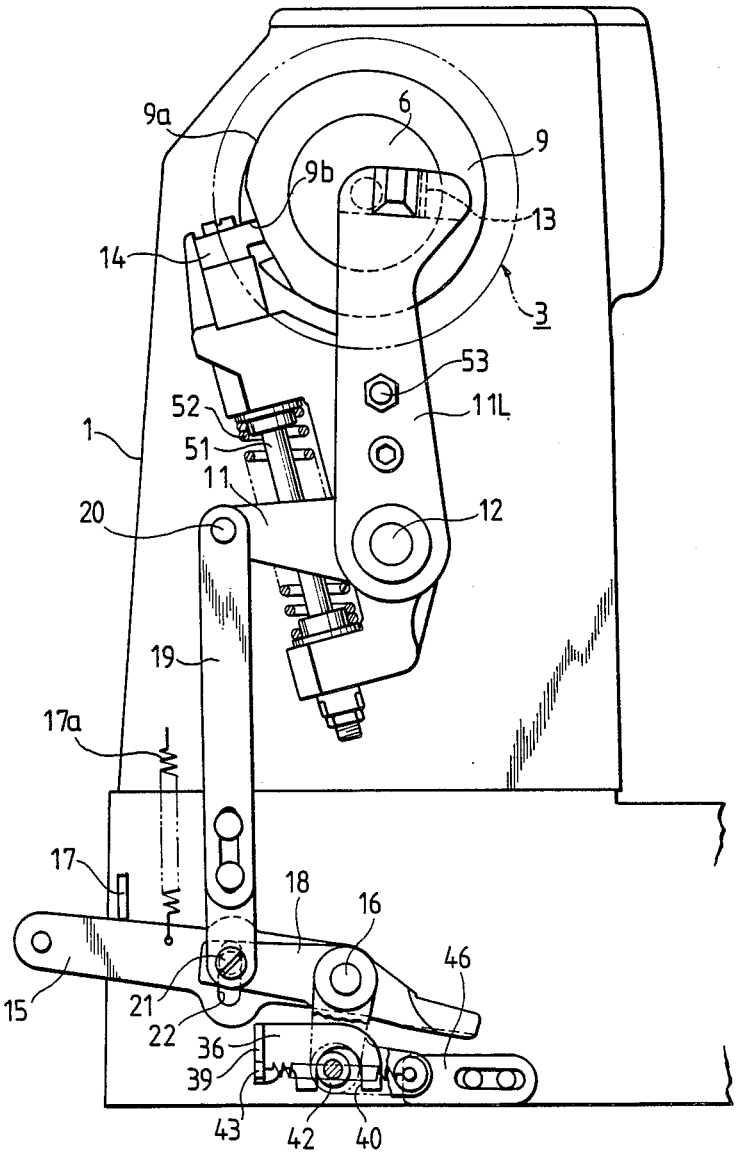
FIG. 2 is a fragmentary rear elevational view of the cyclic sewing machine of the first embodiment.

FIGS. 1 and 2 show a cyclic sewing machine provided with the control device according to the present invention. A sewing machine main shaft 2 is rotatably supported in a sewing machine frame 1 of the sewing machine and extends outwardly of the frame 1. A clutch mechanism 3 is mounted on an end of the main shaft 2. The clutch mechanism 3 comprises a pair of clutch plates 4, 5 fixedly mounted on the main shaft 2 in spaced relation to each other, a slide sleeve 6 slidably mounted on the main shaft 2 between the clutch plates 4, 5 for sliding movement along the main shaft 2, the slide sleeve 6 being normally urged to the right side in FIG. 1, and low- and high-speed pulleys 7, 8 rotatably mounted on the slide sleeve 6. The clutch plate 4 has a constant-position stop cam 9 thereon, and the slide sleeve 6 supports a ball 10 thereon. The low- and high-speed pulleys 7, 8 are connected to a driving source 70 comprising pulleys 71,72 and a motor 73.

A switching body 11 is rotatably supported on the frame 1 by means of a support shaft 12 the axis of which is parallel to that of the main shaft 2. A support shaft 51 is supported by the switching body 11 and provided at the upper end with an engaging projection 14 for selectively engaging a peripheral edge 9*a* and a recess 9*b* of the constant-position stop cam 9. A spring 52 is interposed between the engaging projection 14 and the switching body 11 so as to absorb the shock of engagement of the engagement projection 14 with the recess 9*b*.

A switching lever 11L is adjustably secured to the switching body 11 by fastening means 53. As a result, a switching lever 11L is angularly movably supported on the sewing machine frame 1 by means of a support shaft 12 and has a cam surface 13 on an upper surface thereof which is held in engagement with the ball 10. As shown in FIG. 5(*a*), the cam surface 13 has three engaging surfaces 13*a*, 13*b*, 13*c* of different heights which corresponds respectively to a power cutoff condition, a low-speed drive condition, and a high-speed drive condition of the clutch mechanism 3, and also has slanted surfaces 13*d*, 13*e* interconnecting the engaging surfaces 13*a*, 13*b*, 13*c*.

When the first engaging surface 13*a* of the cam surface 13 engages the ball 10 in response to angular movement of the switching lever 11L as shown in FIG. 5(*a*), the pulleys 7, 8 are disengaged from the respective clutch plates 4, 5 to keep the clutch mechanism 3 in the power cutoff condition. When the second engaging surface 13*b* of the cam surface 13 engages the ball 10 as shown in FIG. 6(*a*), the low-speed pulley 7 engages the clutch plate 4 to keep the clutch mechanism 3 in the low-speed drive condition, thus connecting the main shaft 2 to a low-speed drive source through a belt 7*a* trained around the low-speed pulley 7. When the third engaging surface 13*c* of the cam surface 13 engages the ball 10 as shown in FIG. 8(*a*), the high-speed pulley 8 engages the other clutch plate 5 to keep the clutch mechanism in the high-speed drive condition, thus connecting the main shaft 2 to a high-speed drive source through a belt 8*a* trained around the high-speed pulley 8.

The engaging projection 14 engages in the recess 9*b* when the first engaging surface 13*a* of the cam surface 13 engages the ball 10. A control lever 15 as a control member is angularly movably supported on the sewing machine frame 1 by means of a support shaft 16. The control lever 15 is normally urged into a rest position engaging a stopper 17 under the biasing force of a spring 17*a* as shown in FIG. 2. An intermediate operating lever 18 having three arms is angularly movably supported at its intermediate portion on the support shaft 16. The intermediate operating lever 18 and the switching lever 11L are interlinked by a connecting bar 19 through a pair of upper and lower connecting pins 20, 21. The switching lever 11L, the intermediate operating lever 18, and the connecting bar 19 jointly constitute a switching assembly. The control lever 15 has an oblong hole 22 defined therein and positioned along an arc about the support shaft 16, and the lower connecting pin 21 is loosely fitted in the oblong hole 22.

Figure 3:
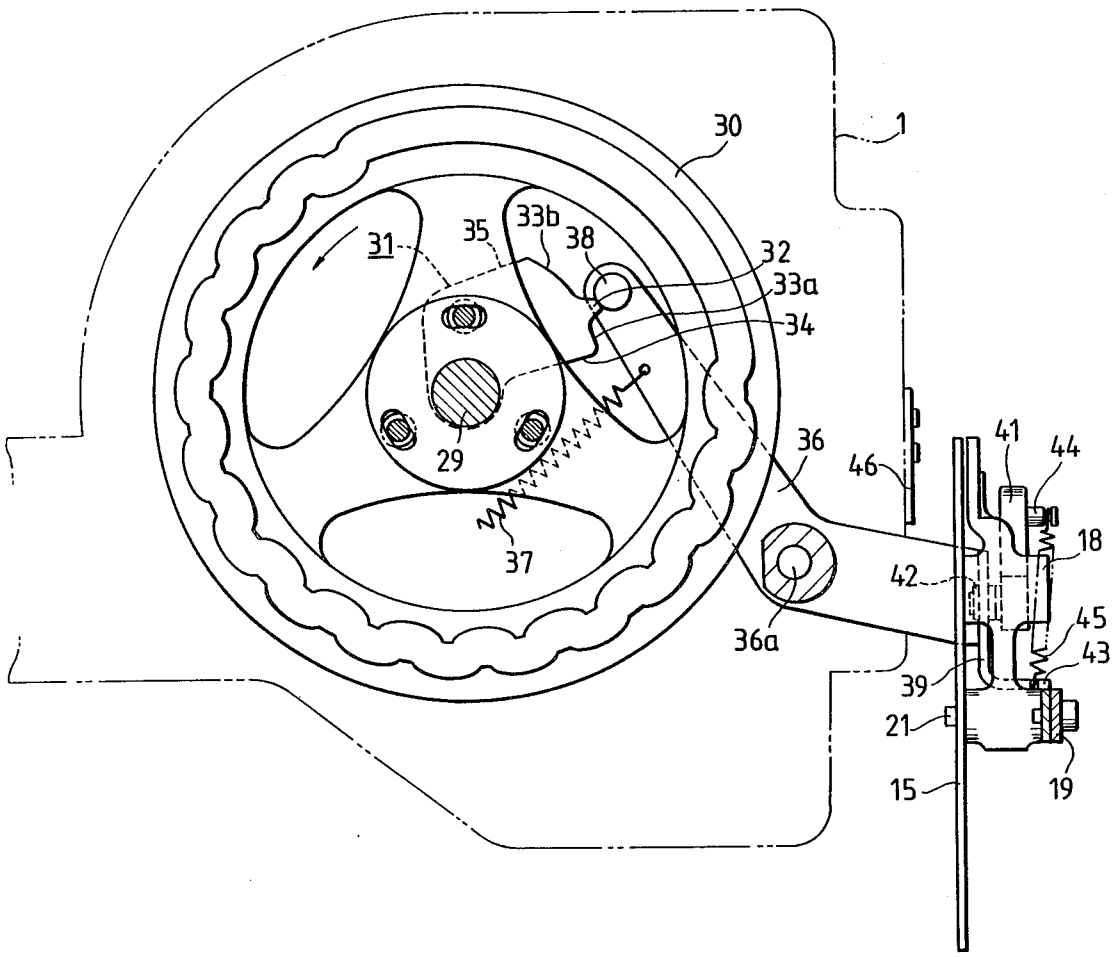
FIG. 3 is a fragmentary plan view of the cyclic sewing machine embodying the principles of the first embodiment of the present invention.

As illustrated in FIGS. 1 and 3, a feed control cam 30 for controlling operation of a fabric feed device (not shown) and a speed control cam 31 for controlling the rotational speed of the main shaft 2 are supported on a rotatable shaft 29 in the sewing machine frame 1 for corotation about a vertical axis. The cams 30, 31 make one revolution per sewing cycle in response to rotation of the main shaft 2. The speed control cam 31 has a first control surface 32 on the outer peripheral edge thereof and corresponding to the power cutoff condition for the main shaft 2, and second control surfaces 33*a*, 33*b* of the same radius of curvature which are positioned on each side of the first control surface 32, the second control surfaces 33*a*, 33*b* being positioned radially inwardly of the first control surface 32 and corresponding to the low-speed drive condition for the main shaft 2. The speed control cam 31 also has a transition surface 34 on the outer peripheral edge thereof which extends from an end of the second control surface 33*a* that is positioned behind the first control surface 32 with respect to the direction of rotation of the speed control cam 31, toward the center of rotation of the speed control cam 31. The speed control cam 31 further includes a guide surface 35 extending from an end of the second control surface 33*b* that is positioned in front of the first control surface 32 with respect to the direction of rotation of the first control surface 32, toward the center of rotation of the speed control cam 31.

As shown in FIG. 3, an operating member 36 is swingably supported at its intermediate portion on the sewing machine frame 1 by means of a support shaft 36*a* and a cam follower 38 is mounted on an end of the operating member 36 in engagement with the speed control cam 31. The operating member 36 is normally urged to move the cam follower 38 in a direction to engage the speed control cam 31 by a first urging means 37 comprising a coil spring. A stopper 46 serving as a third control surface is mounted on the sewing machine frame 1 on one side of the speed control cam 31. The operating member 36 is limited in its counterclockwise swinging movement upon engagement with the stopper 46.

Figure 4:
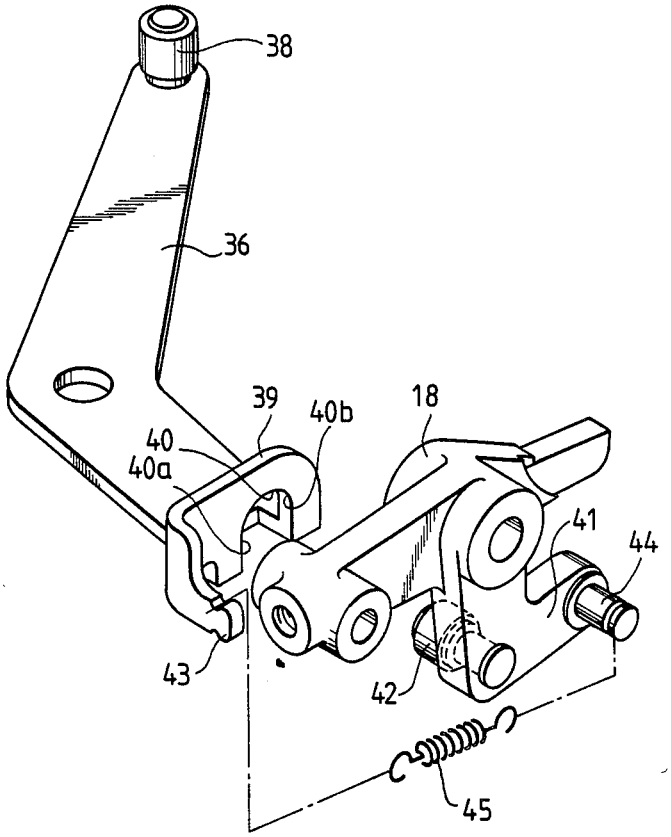
FIG. 4 is an exploded perspective view of an operating member and an intermediate operating lever of the first embodiment.
Figure 5A:
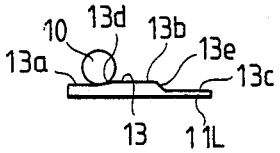
FIGS. 5(*a*) through 11(*d*) are views illustrating a cycle of operation of a control device for the cyclic sewing machine of the first embodiment.
Figure 6A:
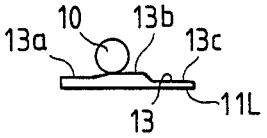
Figure 5B:
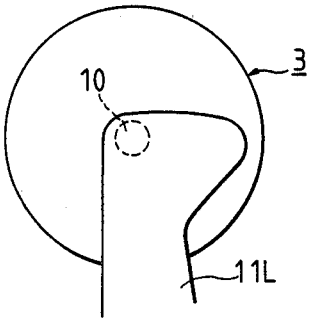
Figure 6B:
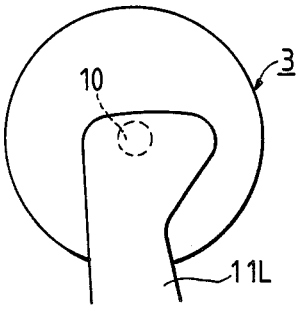
Figure 5C:
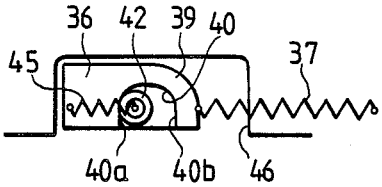
Figure 6C:
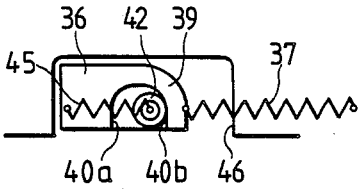
Figure 5D:
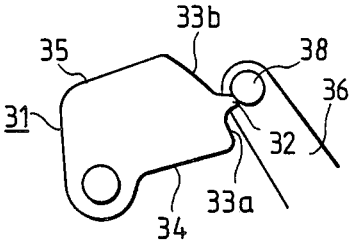
Figure 6D:
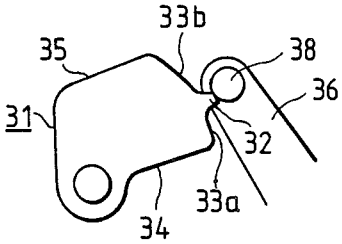

As illustrated in FIGS. 2 and 4, the operating member 36 has on the other end a raised portion 39 having an engageable hole 40 defined therein. The intermediate operating lever 18 has an L-shaped operating arm 41 projecting downwardly and having an engaging pin 42 supported on an intermediate portion thereof, the engaging pin 42 being loosely fitted in the engageable hole 40 and movable into and out of engagement with side edges 40*a*, 40*b* of the engageable hole 40. The engageable hole 40 and the engaging pin 42 jointly serve as a lost-motion connecting means. A second urging means 45 comprising a coil spring is interposed between a spring retainer member 43 projecting from the raised portion 39 of the operating member 36 and a spring retainer pin 44 projecting from the operating arm 41 of the intermediate operating lever 18. The engaging pin 42 is normally urged by the second urging means 45 to move in a direction to engage the side edge 40*a* of the engageable hole 40. The sum of the urging force of the second urging means 45 and the urging force of the spring 17*a* acting on the control lever 15 is smaller than the urging force of the first urging means 37.

Operating of the cyclic sewing machine thus constructed will be described below.

While the sewing machine is not operated, the cam follower 38 on the operating member 36 engages the first control surface 32 of the speed control cam 31 under the bias of the first urging means 37, as shown in FIGS. 3 and 5(*a*) through 5(*d*). Furthermore, the engaging pin 42 on the intermediate operating lever 18 engages the side edge 40*a* of the engageable hole 40 of the operating member 36 under the bias of the second urging means 45, thereby putting the switching lever 11L in the power cutoff position shown in FIGS. 5(*a*) and 5(*b*) through the connecting bar 19. The clutch mechanism 3 is held in the power cutoff condition by engagement of the first engaging surface 13*a* of the switching lever 11L with the ball 10.

When it is desired to drive the sewing machine from the rest position, the operator momentarily steps down the treadle (not shown) connected to the control lever 15, the control lever 15 is now turned counterclockwise in FIG. 2 against the bias of the spring 17*a* to bring the upper end of the oblong hole 22 in the control lever 15 into engagement with the connecting pin 21. The intermediate operating lever 18 is also turned in the same direction as the control lever 15 until the engaging pin 42 disengages from the side edge 40*a* and engages the side edge 40*b*, as shown in FIG. 6(*c*). At this time, the operating member 36 is kept in the power cutoff position shown in FIGS. 5(*d*) and 6(*d*) by engagement of the cam follower 38 with the first control surface 32 of the speed control cam 31. As the intermediate operating lever 18 is turned, the switching lever 11L is angularly shifted from the position of FIG. 5(*a*) to the position of FIG. 6(*a*) to bring the second engaging surface 13*b* into engagement with the ball 10, while the operating member 36 is not turned to cause a lost-motion by the lost-motion connecting means. The clutch mechanism 3 is now switched into the low-speed drive condition to rotate the main shaft 2 at a low speed.

Figure 7A:
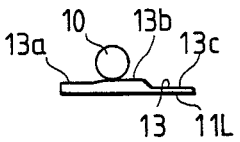
Figure 8A:
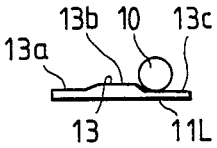
Figure 7B:
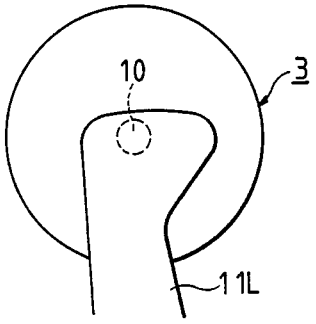
Figure 8B:
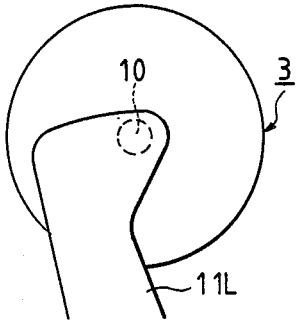
Figure 7C:
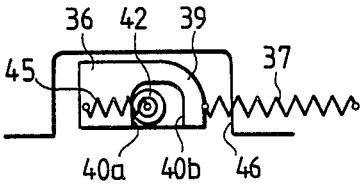
Figure 8C:
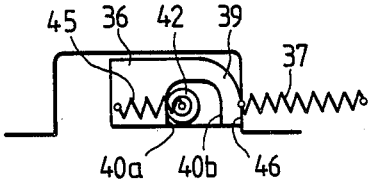
Figure 8D:
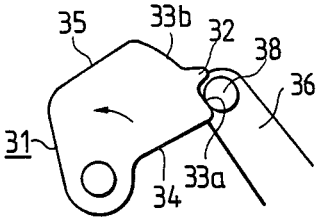
Figure 8D:
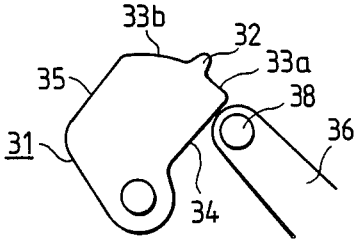
Figure 9A:
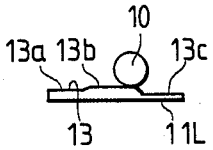
Figure 10A:
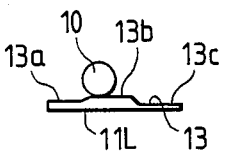
Figure 9B:
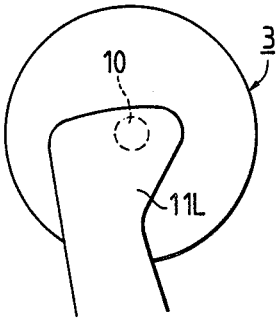
Figure 10B:
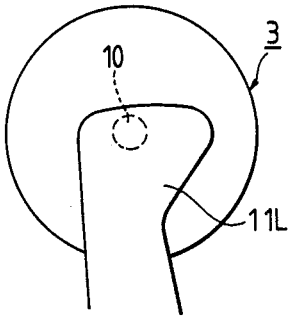
Figure 9C:
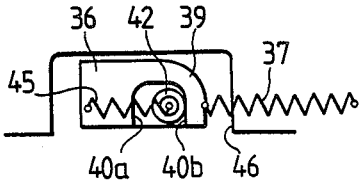
Figure 10C:
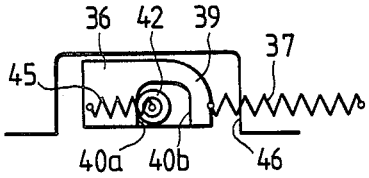
Figure 9D:
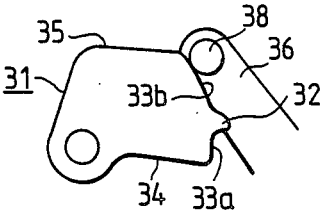
Figure 10D:
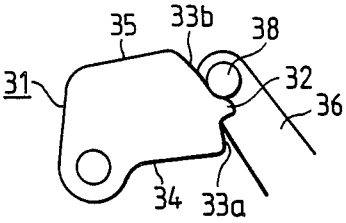
Figure 11A:
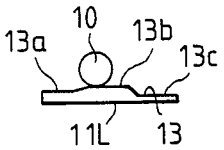
Figure 11B:
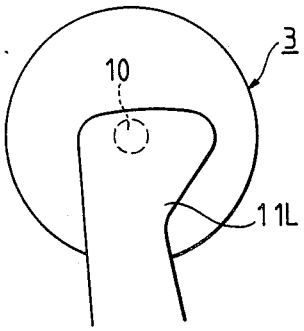
Figure 11C:
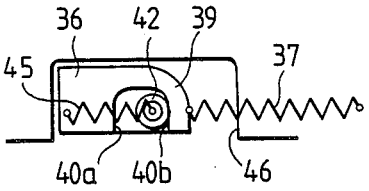
Figure 11D:
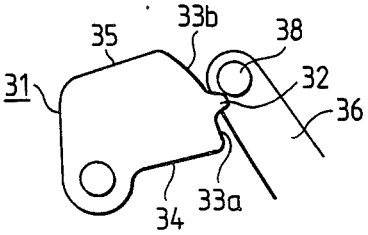
Figure 12:
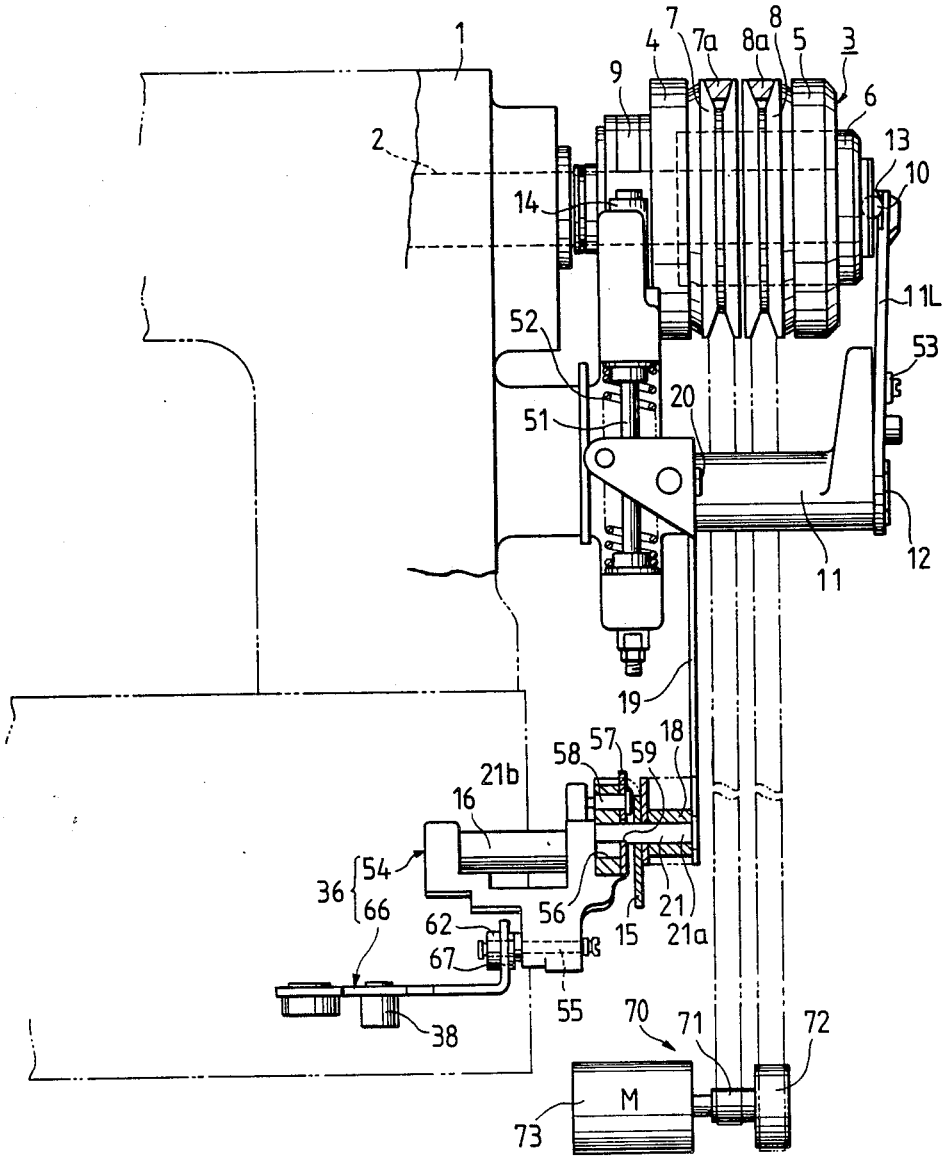
FIG. 12 is a fragmentary side elevational view of the cyclic sewing machine of a second embodiment of the present invention.

In response to the low-speed rotation of the main shaft 2, the speed control cam 31 is rotated counterclockwise at a reduced speed in FIG. 3. The first control surface 32 disengages from the cam follower 38 on the operating member 36, and the second control surface 33*a* contacts the cam follower 38, whereupon the operating member 36 is swung from the position of FIG. 6(*d*) to the position of FIG. 7(*d*) under the resiliency of the first urging means 37. As shown in FIG. 7(*c*), the side edge 40*b* of the engageable hole 40 disengages from the engaging pin 42, and the other side edge 40*a* engages the engaging pin 42. At this time, the swinging movement of the operating member 36 is not transmitted to the intermediate operating lever 18, so that the switching lever 11L is maintained in the low-speed position as shown in FIGS. 7(*a*) and 7(*b*). Thus, the main shaft 2 continues to rotate at the low speed.

As the speed control cam 31 continuously rotates, the cam follower 38 on the operating member 36 disengages from the second control surface 33*a*, as shown in FIG. 8(*d*), whereupon the operating member 36 is further swung counterclockwise in FIG. 3 along the transition surface 34 under the bias of the first urging mean 37 until the operating member 36 engages the stopper 46 which stops further swinging movement of the operating member 36. Upon the swinging movement of the operating lever 36, the intermediate operating lever 18 also turns with the operating member 36 through the engagement between the side edge 40*a* and the engaging pin 42. This turning movement of the intermediate operating lever 18 causes the switching lever 11L to be shifted from the low-speed drive position shown in FIG. 7(*b*) into the high-speed drive position shown in FIG. 8(*b*). The second engaging surface 13*b* now disengages from the ball 10, and the third engaging surface 13*c* engages the ball 10, switching the clutch mechanism 3 into the high-speed drive condition to rotate the main shaft 2 at a high speed.

Continued rotation of the speed control cam 31 causes the cam follower 38 to move along the guide surface 35 of the speed control cam 31 against the bias of the first urging means 37, after which the cam follower 38 engages the second control surface 33*b* whereupon the operating member 36 swings from the position of FIG. 8(*d*) back to the position of FIG. 9(*d*). The side edge 40*a* of the engageable hole 40 disengages from the engaging pin 42, and thereafter the side edge 40*b* engages the engaging pin 42 to transmit the returning angular movement of the operating member 36 to the switching lever 11L. The switching lever 11L is then swung from the high-speed drive position shown in FIG. 8(*b*) back to the low-speed drive position shown in FIG. 9(*b*). The third engaging surface 13*c* disengages from the ball 10, and the second engaging surface 13*b* engages the ball 10 again. Consequently, the clutch mechanism 3 is shifted into the low-speed drive condition, thus rotating the main shaft 2 at the low speed.

Upon subsequent rotation of the speed control cam 31 as shown in FIGS. 9(*c*) and 10(*c*), while the operating member 36 is being kept in the low-speed drive position within an angular range of the second control surface 33*b* through engagement between the second control surface 33*b* and the cam follower 38, the engaging pin 42 is shifted out of engagement with the side edge 40*b* and into engagement with the side edge 40*a* under the bias of the second urging means 45, and the switching lever 11 is angularly moved back along the second engaging surface 13*b* into the low-speed drive position shown in FIG. 10(*b*).

When the speed control cam 31 is further continuously rotated, the first control surface 32 engages the cam follower 38 again as shown in FIG. 11(*d*) to swing the operating member 36 from the position of FIG. 10(*d*) via the position of FIG. 11(*d*) back to the position of FIG. 5(*d*) against the bias of the first urging means 37. In response to such swinging movement of the operating member 36, the side edge 40*a* disengages from the engaging pin 42, and the side edge 40*b* engages the engaging pin 42 to turn the switching lever 11 from the low-speed drive position of FIG. 10(*b*) back to the power cutoff position of FIG. 5(*b*). The second engaging surface 13*b* disengages from the ball 10, and the first engaging surface 13*a* engages the ball 10, whereupon the clutch mechanism 3 is shifted into the power cutoff condition, and the engaging projection 14 engages in the recess 9*b* of the constant-position stop cam 9, thus stopping rotation of the main shaft 2.

With the above embodiment, since the cam follower 38 on the operating member 36 engages the speed control cam 31 and it is not necessary to turn the control lever 15 against the large biasing force of the first urging means 37, the force to be applied to the control lever 15 is small and so is the physical burden of the operator. Further, when switching the sewing machine from the power cutoff condition to the low-speed drive condition, a lost-motion is produced between the operating member 36 and the switching lever 11L. Therefore, since the first control surface 32 for stopping the rotation of the main shaft 2 projects radially outwardly of the second control surfaces 33*a*, 33*b* for rotating the main shaft 2 at the low speed and the second control surface 33*b* projects radially outwardly of the guide surface 35 for rotating the main shaft 2 at the high speed, the operating member 36 is forcibly operated against the bias of the first urging means 37 by the second control surface 33*b* and the first control surface 32 when the rotation of the main shaft 2 is to be stopped. As a result, the main shaft 2 can be stopped smoothly and stably after reducing the speed of the main shaft 2 from the high speed to the low speed, thus eliminating shocks applied to the various other components and preventing damage to these components.

The present invention is not limited to the above embodiment, but may be modified as follows:

(a) Third control surfaces of the same radius of curvature may be integrally formed on the speed control cam 31 radially inwardly of the second control surfaces 33*a*, 33*b*.

(b) The engaging pin 42 may be mounted on the operating member 36, and the engageable hole 40 may be defined in the intermediate operating lever 18.

A second embodiment of the present invention will hereinafter be described with reference to FIGS. 12 through 20.

In these drawings, like parts and components are designated by the same reference numerals and characters as those shown in FIGS. 1 through 11.

Figure 14:
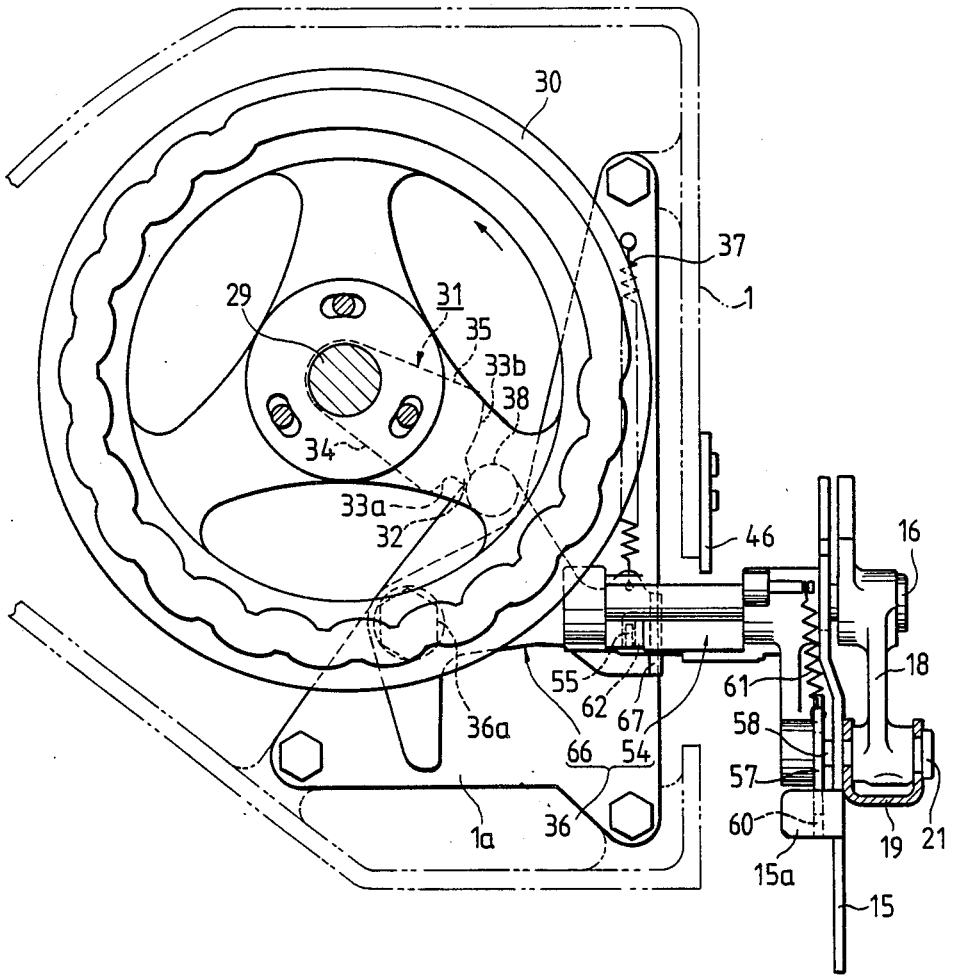
FIG. 14 is a fragmentary plan view of a cyclic sewing machine embodying the principles of the second embodiment of the present invention.
Figure 15:
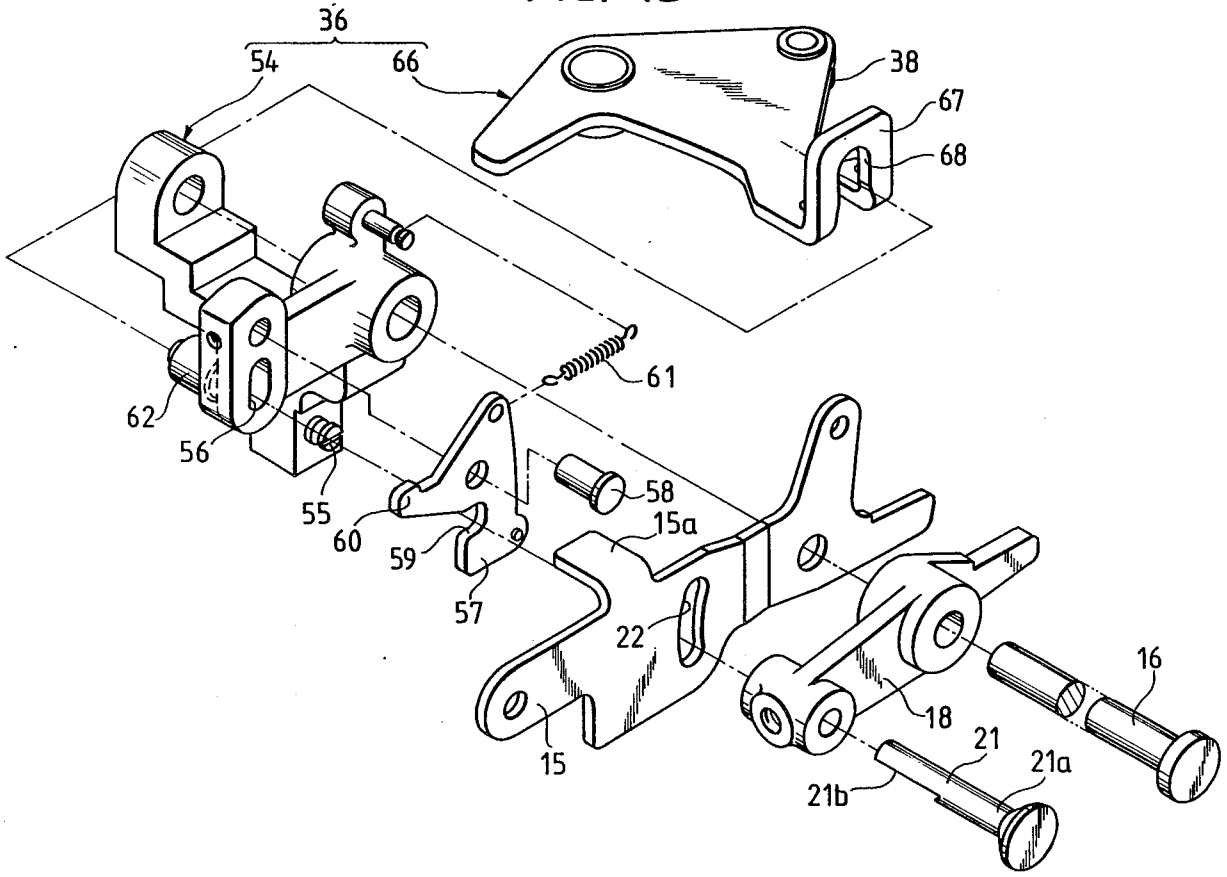
FIG. 15 is an exploded perspective view of an operating member, and a limiting member of the second embodiment.
Figure 16A:
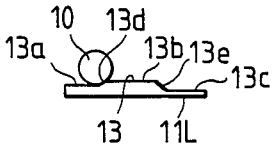
FIGS. 16(*a*) through 20(*d*) are views illustrating a cycle of operation of a control device for the cyclic sewing machine of the second embodiment.
Figure 17A:
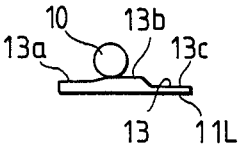
Figure 16B:
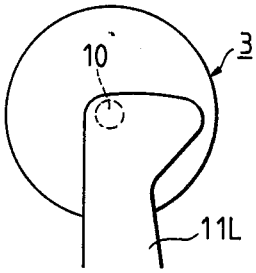
Figure 17B:
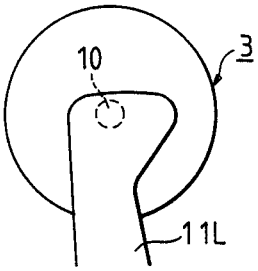
Figure 16C:
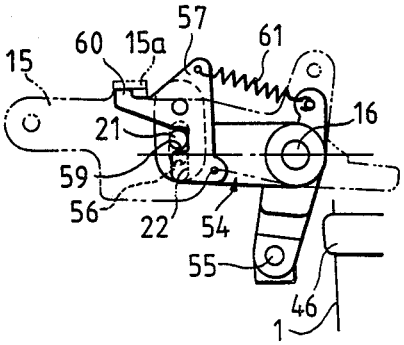
Figure 17C:
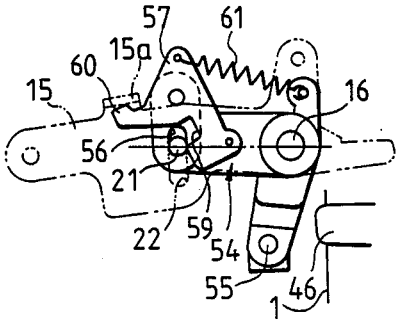
Figure 16D:
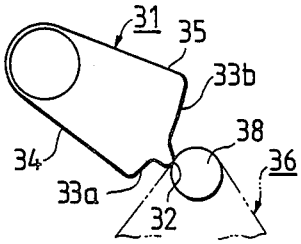
Figure 17D:
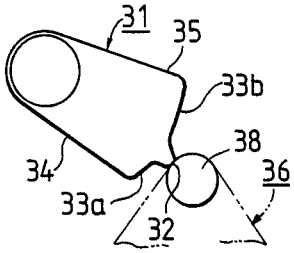
Figure 18A:
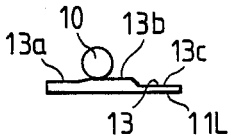
Figure 19A:
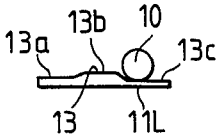
Figure 18B:
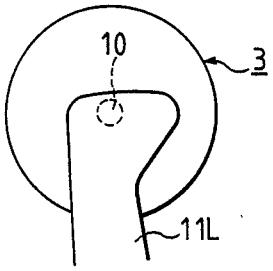
Figure 19B:
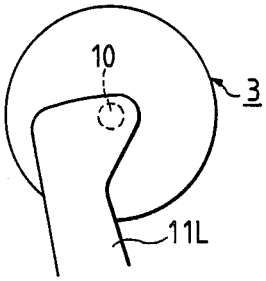
Figure 18C:
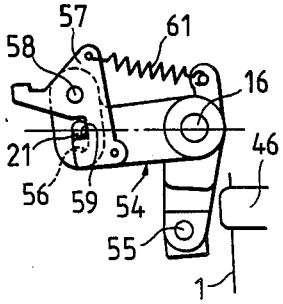
Figure 19C:
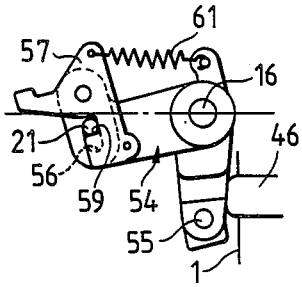
Figure 18D:
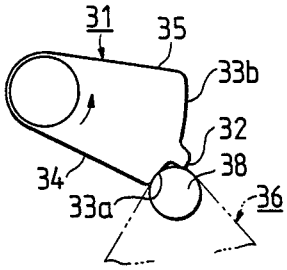
Figure 19D:
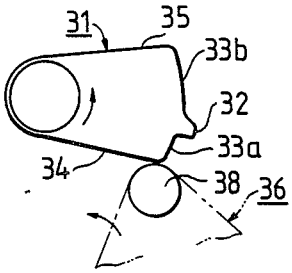
Figure 20A:
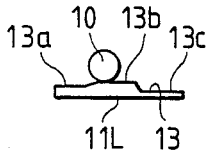
Figure 20B:
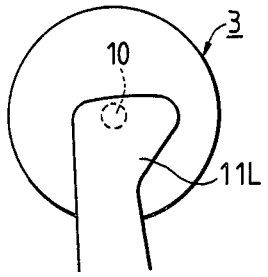
Figure 20C:
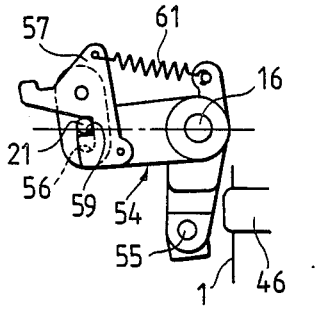
Figure 20D:
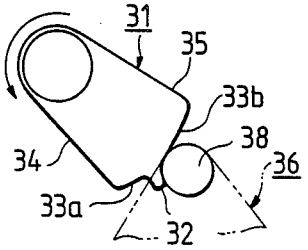

A support plate 1*a* which is of a substantially triangular shape is attached as its corners to the sewing machine frame 1 below the feed control cam 30 as shown FIG. 14. As shown in FIGS. 14 and 15, a operating member 36 comprises operating body 54 and operating link 66, the operating link 66 is swingably supported at its intermediate portion on the upper surface of the support plate 1*a* by means of a support shaft 36*a*. The operating link 66 supports on its intermediate projecting portion a cam follower 38 which is held in engagement with the speed control cam 31. A coil spring 37 serving as an urging means is interposed between the right-hand end of the operating link 66 and the support plate 1*a* for normally urging the operating link 66 to turn counterclockwise, i.e., in a direction to cause the cam follower 38 to engage the speed control cam 31.

Further, the operating link 66 has a connecting hole 68 defined in a raised portion 67 bent from the right-hand end of the operating link 66. The operating body 54 is swingably supported on the support shaft 16 between the operating link 66 and the control lever 15. The operating body 54 has a downward projection on which an eccentric shaft 55 is mounted with its angular position adjustable. A roller 62 which is fitted in the connecting hole 68 is angularly movably mounted on the eccentric shaft 55. With the roller 62 fitted in the connecting hole 68, the operating link 66 and the operating body 54 are operatively connected to each other. By adjusting the angular position of the eccentric shaft 55, the position of the roller 62 is changed to adjust the position in which the operating body 54 is coupled to the operating link 66. The operating link 66 and the operating body 54 jointly serve as a operating member.

A stopper 46 serving as a third control surface is mounted on the sewing machine frame 1 on one side of the speed control cam 31. The operating link 66 is limited in its counterclockwise swinging movement upon engagement of the operating body 54 with the stopper 46.

As illustrated in FIGS. 14, 15, and 16(*c*), the operating body 54 has an arcuate oblong engageable hole 56 defined in the distal end of a lateral projection thereof and extending about the support shaft 16. The connecting pin 21 has a intermediate portion 21*a* of a circular cross-section and a distal end portion 21*b* of a D-shaped cross-section which is inserted in the oblong hole 56, the distal end portion 21*b* having a downward flat surface. The connecting pin 21 serves as an engaging pin. The control lever 15 has an oblong hole 22 defined therein an positioned along an arc about the support shaft 16, and the intermediate portion 21*a* of the connecting pin 21 is loosely fitted in the oblong hole 22. And, the control lever 15 is operatively connected to the intermediate operating lever 18 by the connecting pin 21.

A limiting member 57 is swingably supported at its intermediate portion on the distal end of the lateral projection of the operating body 54 by means of a support shaft 58. The limiting member 57 has a recess 59 defined in the outer edge of an intermediate portion thereof for selective engagement with the distal end portion 21*b* of the connecting pin 21. The limiting member 57 also has an integral engaging portion 60 which can selectively engages a projection 15*a* bent from an upper side edge of the control lever 15. A tension spring 61 is interposed between the limiting member 57 and the operating body 54 for normally urging the limiting member 57 to turn clockwise in FIG. 13.

Operation of the cyclic sewing machine thus constructed will be described below.

While the sewing machine is not operated, the cam follower 38 on the operating member 36 engages the first control surface 32 of the speed control cam 31 under the bias of the coil spring 37 as the urging means, as shown in FIGS. 14 and 16(*a*) through 16(*d*). Furthermore, a side edge of the recess 59 in the limiting member 57 engages the distal end portion 21*b* of the connecting pin 21 to hold the distal end portion 21*b* in engagement with an upper end of the oblong hole 56 in the operating body 54. The switching lever 11L is thus put in the power cutoff position shown in FIGS. 16(*a*) and 16(*b*) through the intermediate operating lever 18 and the connecting bar 19. The clutch mechanism 3 is held in the power cutoff condition by engagement of the first engaging surface 13*a* of the switching lever 11L with the ball 10.

Figure 13:
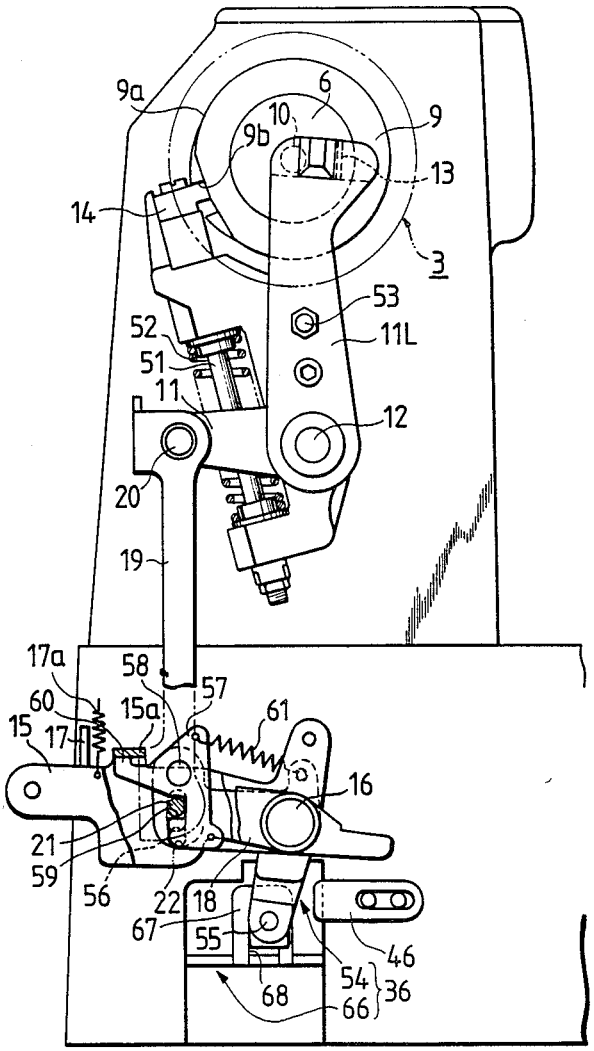
FIG. 13 is a fragmentary rear elevational view of the cyclic sewing machine of the second embodiment.

The control lever 15 is now turned counterclockwise in FIG. 13 against the bias of the spring 17*a* to bring the projection 15*a* of the control lever 15 into engagement with the engaging portion 60 of the limiting member 57 to turn the limiting member 57 counterclockwise against the bias of the tension spring 61, thus separating the recess 59 from the distal end portion 21*b* of the connecting pin 21. At the same time, engagement between the upper end of the oblong hole 22 in the control lever 15 and the connecting pin 21 causes the distal end portion 21*b* to move downwardly in the oblong hole 56 in the operating body 54, providing a lost-motion between the connecting pin 21 and the oblong hole 56.

As the connecting pin 21 is moved, the switching lever 11L is shifted from the position shown in FIGS. 16(*a*) and 16(*b*) to the low-speed drive position shown in FIGS. 17(*a*) and 17(*b*) through the connecting bar 19, thereby bringing the second engaging surface 13*b* of the switching lever 11L into engagement with the ball 10. The clutch mechanism 3 is now switched into the low-speed drive condition to rotate the main shaft 2 at a low speed. When the lost-motion is generated, since the operating body 54 is held at rest, the operating link 66 is maintained in the same position as when the lost-motion is started, as illustrated in FIGS. 16(*d*) and 17(*d*).

In response to the low-speed rotation of the main shaft 2, the speed control cam 31 is rotated counterclockwise at a reduced speed in FIG. 14. The first control surface 32 disengages from the cam follower 38 on the operating link 66, and the cam follower 38 contacts the second control surface 33*a*, whereupon operating link 66 is swung counterclockwise from the position of FIG. 17(*d*) to the position of FIG. 18(*d*) under the resiliency of the coil spring 37 (see FIG. 14).

Through the fitting engagement between the connecting hole 68 and the roller 62, the operating body 54 is swung counterclockwise from the position shown in FIG. 17(*c*) to the position shown in FIG. 18(*c*) until the upper end of the oblong hole 56 engages the connecting pin 21 again. At this time, the swinging movement of the operating body 54 is not transmitted to the switching lever 11L, so that the switching lever 11L is maintained in the low-speed drive position as shown in FIGS. 18(*a*) and 18(*b*). Thus, the main shaft 2 continues to rotate at the low speed.

When the upper end of the oblong hole 56 engages the connecting pin 21, the limiting member 57 is angularly moved about the support shaft 58 from the position shown in FIG. 17(*c*) back to the position shown in FIG. 18(*c*) under gravity and the bias of the tension spring 61. The side edge of the recess 59 engages the connecting pin 21 again to prevent any lost-motion from occurring between the connecting pin 21 and the oblong hole 56.

Thereafter, as the speed control cam 31 continuously rotates in response to rotation of the main shaft 2, the cam follower 38 on the operating link 66 disengages from the second control surface 33*a*, whereupon the operating link 66 is further swung counterclockwise in FIG. 14 along the transition surface 34 under the bias of the coil spring 37 until the operating body 54 interlinked with the operating link 66 engages the stopper 46. The stopper 46 now stops further swinging movement of the operating link 66 in the position shown in FIG. 19(*d*).

Upon the swinging movement of the operating link 66, since no lost-motion is allowed by the limiting member 57, the switching lever 11L is shifted from the low-speed position shown in FIG. 18(*b*) into the high-speed drive position shown in FIG. 19(*b*) through the operating body 54, the connecting pin 21, the limiting member 57, and the connecting bar 19. The second engaging surface 13*b* now disengages from the ball 10, and the third engaging surface 13*c* engages the ball 10, switching the clutch mechanism 3 into the high-speed drive condition to rotate the main shaft 2 at a high speed.

Continued rotation of the speed control cam 31 causes the cam follower 38 to move along the guide surface 35 of the speed control cam 31 against the bias of the coil spring 37, after which the cam follower 38 engages the second control surface 33*b* whereupon the operating link 66 swings from the position of FIG. 19(*d*) back to the position of FIG. 20(*d*). With no lost motion being permitted, the switching lever 11L is then swung from the high-speed drive position shown in FIG. 19(*b*) back to the low-speed drive position shown in FIG. 20(*b*) through the operating body 54, the connecting pin 21, the limiting member 57, and the connecting bar 19. The third engaging surface 13*c* disengages from the ball 10, and the second engaging surface 13*b* engages the ball 10 again. Consequently, the clutch mechanism 3 is shifted into the low-speed drive condition, thus rotating the main shaft 2 at the low speed.

Upon subsequent rotation of the speed control cam 31, the first control surface 32 engages the cam follower 38 again, causing the operating link 66 to swing back to the position shown in FIG. 16(*d*) against the bias of the coil spring 37. In response to such swinging movement, the switching lever 11L is angularly moved from the low-speed drive position shown in FIG. 20(*b*) back to the power cutoff position shown in FIG. 16(*b*) while any lost-motion is prohibited. The second engaging surface 13*b* disengages from the ball 10, and the first engaging surface 13*a* engages the ball 10, whereupon the clutch mechanism 3 is shifted into the power cutoff condition, and the engaging projection 14 engages in the recess 9*b* of the constant-position stop cam 9, thus stopping rotation of the main shaft 2.

With the above embodiment, when switching the sewing machine from the power cutoff condition to the low-speed drive condition, a lost-motion is produced between the operating member 36 and the switching lever 11L, when switching the sewing machine from the high-speed drive condition to the low-speed drive condition and from the low-speed drive condition to the power cutoff condition, any lost-motion is prohibited between the operating member 36 and the switching lever 11L by the limiting member 57. Therefore, each switching movement can reliably be carried out, and the main shaft 2 can smoothly and reliably be stopped after reducing the speed of the main shaft 2 from the high speed to the low speed. Consequently, fabric feeding operation can reliably be performed according to the cam profile of the feed control cam 30, so that unwanted variations in the number of stitches to sew by the sewing machine will be prevented from occurring due to failures to stop operation of the sewing machine.

In view of the foregoing, according to the present invention, operation of the sewing machine can smoothly and stably be stopped, and various components of the sewing machine are prevented from being damaged.

What is claimed is:

1. A control device for a cyclic sewing machine for controlling the driving condition of a sewing machine main shaft rotatably supported on a sewing machine frame and connected to a driving source; said control device comprising:

a clutch mechanism provided between said driving source and said main shaft said clutch mechanism including at least one pulley rotatably provided on the main shaft and rotated by said driving source and at least one clutch member rotatable together with said main shaft;

a switching member movable selectively into three different positions for switching a clutch mechanism between a power cutoff condition, a low-speed drive condition, and a high-speed drive condition with relative movement of said pulley and said clutch member in an axial direction of said main shaft;

an engaging member connected to said switching member for engaging with said main shaft and stopping the rotation thereof when said switching member is moved into the position corresponding to said power cutoff condition;

a control cam rotatable at a reduced speed in interlinked relation to said main shaft, said control cam including a first control portion corresponding to the power cutoff condition for the main shaft, second control portions disposed on each side of said first control portion radially inwardly of said first control portion toward the center of rotation of the control cam and corresponding to said low-speed drive condition, and a transition portion extending radially inwardly of said second control portions toward the center of rotation of said control cam;

an operating member movably mounted on said frame and operatively coupled to said switching member, said operating member being engageable with said control cam;

a third control portion integral with or separate from said control cam for limiting further movement of said operating member which has moved from said second control portions past said transition portion, said third control portion corresponding to the high-speed drive condition for said main shaft;

an urging means for normally urging said operating member in a direction to engage said control cam;

a lost-motion connecting means disposed between said operating member and said switching member to produce a lost-motion; and, a control member operatively coupled to said switching member and operable under an applied external force for moving said switching member from said power cutoff condition to said low-speed drive condition to rotate said main shaft at a low speed.

2. A control device as defined in claim 1, said lost motion connecting means comprising an engaging pin and an engageable hole in which said engaging pin is loosely fitted.

3. A control device as defined in claim 2, further comprising urging means disposed between said operating member and said switching member for normally urging said engaging pin against one side edge of said engageable hole.

4. A control device as defined in claim 1, said operating member comprising an operating link and an operating body, said lost-motion connecting means comprising a connecting pin and an engageable hole defined in said operating body, said connecting pin being loosely fitted in said engageable hole.

5. A control device as defined in claim 1, further comprising a limiting member disposed between said operating member and said switching member for allowing said lost-motion connecting means to produce a lost-motion only when said control member is operated.

* * * * *